US005261141A

United States Patent [19]

La Boda

[11] Patent Number: 5,261,141

[45] Date of Patent: Nov. 16, 1993

[54] INDUSTRIAL SWEEPER CONTROL

[75] Inventor: John A. La Boda, Fairview Park, Ohio

[73] Assignee: Shop Vac Corporation, Williamsport, Pa.

[21] Appl. No.: 938,880

[22] Filed: Aug. 31, 1992

[51] Int. Cl.[5] ..... A47L 11/24; A47L 11/40

[52] U.S. Cl. ..... 15/52.1; 15/50.2; 15/79.2; 15/83; 15/340.2; 56/11.8; 74/480 R; 192/48.7

[58] Field of Search ..... 15/49.1, 50.1, 50.3, 15/52.1, 79.2, 82, 83, 340.2; 37/244–246; 56/11.5, 11.6, 11.8, 10.8; 192/48.7; 74/480 R

[56] References Cited

U.S. PATENT DOCUMENTS

| | | | |
|---|---|---|---|
| 3,284,830 | 11/1966 | Kroll | 15/52.1 |
| 3,614,801 | 10/1971 | Peabody | 15/179 |
| 3,820,186 | 6/1974 | Peabody | 15/182 |
| 3,833,961 | 9/1974 | Fortman et al. | 15/50.3 |
| 3,892,003 | 7/1975 | Peabody | 15/340.3 |
| 3,892,008 | 7/1975 | Christensen et al. | 15/340.3 |
| 3,921,373 | 11/1975 | Rubin | 15/79.2 |
| 3,979,789 | 9/1976 | Peabody et al. | 15/340.3 |
| 4,161,639 | 7/1979 | Nofel | 200/157 |
| 4,165,551 | 8/1979 | Rosseau | 15/179 |
| 4,212,141 | 7/1980 | Miyazawa | 56/11.8 |
| 4,216,363 | 8/1980 | Nofel | 200/157 |
| 4,362,228 | 12/1982 | Plamper et al. | 192/0.094 |
| 4,476,643 | 10/1984 | Hilchey et al. | 37/245 |
| 4,524,632 | 6/1985 | Ballard | 74/471 |
| 4,538,401 | 9/1985 | Takamizawa | 56/10.8 |
| 5,152,027 | 10/1992 | La Boda | 15/83 |

*Primary Examiner*—Edward L. Roberts

*Attorney, Agent, or Firm*—Marshall, O'Toole, Gerstein, Murray & Borun

[57] ABSTRACT

An industrial sweeper has brushes, a drivewheel a power source, a lever and cables connecting the lever to clutches which engage the brushes and drive wheel to the power source. When the level is partially depressed, only the brushes are engaged. Full depression of the lever continues engagement of the brushes and also engages the drivewheel to propel the sweeper forward.

3 Claims, 6 Drawing Sheets

INDUSTRIAL SWEEPER CONTROL

BACKGROUND OF THE INVENTION

The present invention relates generally to a device for controlling the brushes and drivewheels of an industrial sweeper and more particularly, to a device which when actuated first causes the brushes to be engaged then, upon further actuation, causes the drivewheel to be engaged.

BACKGROUND ART

Industrial sweepers generally have an engine which drives both brushes and a drivewheel. The brushes spin or rotate in order to sweep up debris, while the drivewheel is in contact with the ground and rotates in order to move the sweeper forward.

Many sweepers have control mechanisms which permit the engagement and disengagement of the brushes or drivewheel while the sweeper's motor is still operating. For instance, U.S. Pat. No. 5,152,027, which is incorporated herein by reference, discloses a sweeper having a cable attached at one of its ends to a handgrip on a handlebar. The other end of the cable is attached to a clutch plate so that a clutch engages the engine to a main drive shaft when the handgrip is depressed. The main drive shaft in turn drives both the brushes and the drivewheel of the sweeper. One drawback of such a system is that the brushes cannot be engaged when the sweeper is stationary. It may, for instance, be desirable to operate only the brushes when the sweeper is over a particularly large pile of dirt or other debris. Stopping the sweeper over the debris however, will also disengage the brushes.

Other control mechanisms have been used, but each has its distinct drawbacks. Some sweepers have brushes connected to the engine so that the brushes are always engaged when the engine is on. A drivewheel is then engaged by use of a clutch connected to a handgrip or similar control. That type of system may be dangerous because the rotating brushes will have a tendency to propel the sweeper. Thus, if the engine is left operating while the sweeper is unattended, movement of the sweeper caused by the rotating brushes may prove hazardous to the user or others.

Another means of controlling the brushes and drive shaft is to have a first control which engages only the brushes and a second control which engages only the drivewheel. However, systems of this type require considerable coordination by the user and may prove difficult to operate. Thus, there remains a need for a control mechanism for a power sweeper which is simple and easy to use and does not permit movement of the brushes when the sweeper is unattended.

SUMMARY OF THE INVENTION

In accordance with present invention, a control device for a sweeper, having a power source capable of driving a brush and a drivewheel, has a lever capable of being positioned at a first position, a second position, and a third position. A first cable and a second cable are each connected to the lever, the first cable capable of causing engagement of the brush with the power source and the second cable capable of causing engagement of the drivewheel with the power source. The brush and drivewheel are disengaged when the lever is in the first position; the brush is engaged and the drivewheel is disengaged when lever is in the second position; and the brush and the drivewheel are both engaged when the lever is in the third position.

More specifically, the lever of the control mechanism may have a first end, a second end, and a middle, about which the lever pivots. The first end is adapted to be gripped by a user's hand, and the second end is attached to the first cable and the second cable. The control device may also have a spring which is connected to the first cable and is also connected to a clutch arm. The clutch arm causes the drivewheel to be engaged when the lever is in the second position. The spring stretches when the lever is moved from the second position to the third position.

DESCRIPTION OF THE PREFERRED EMBODIMENTS

Figure 1:
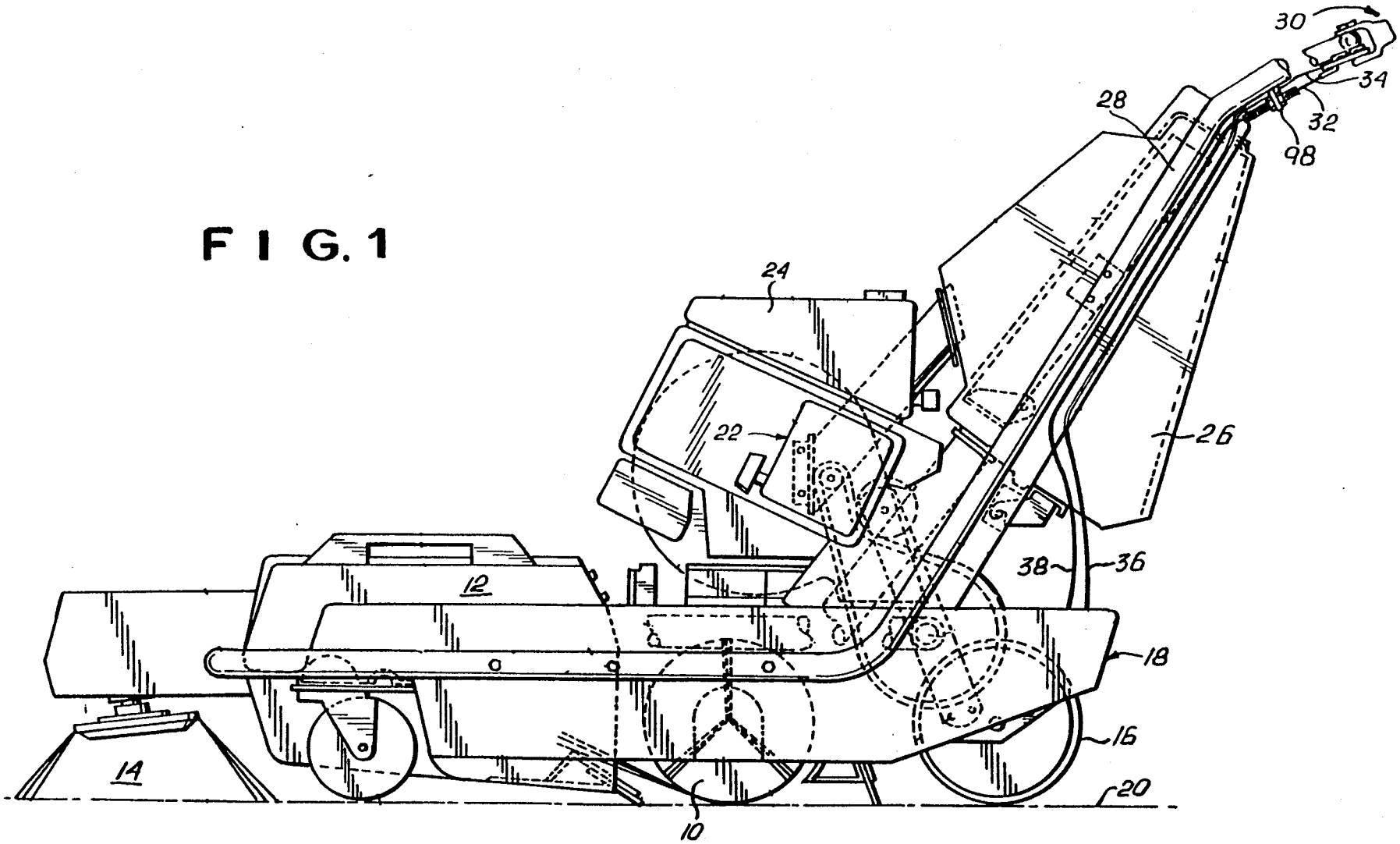
FIG. 1 is a left side elevational view, partially in phantom, of an industrial sweeper incorporating the control mechanism of the present invention.
Figure 2:
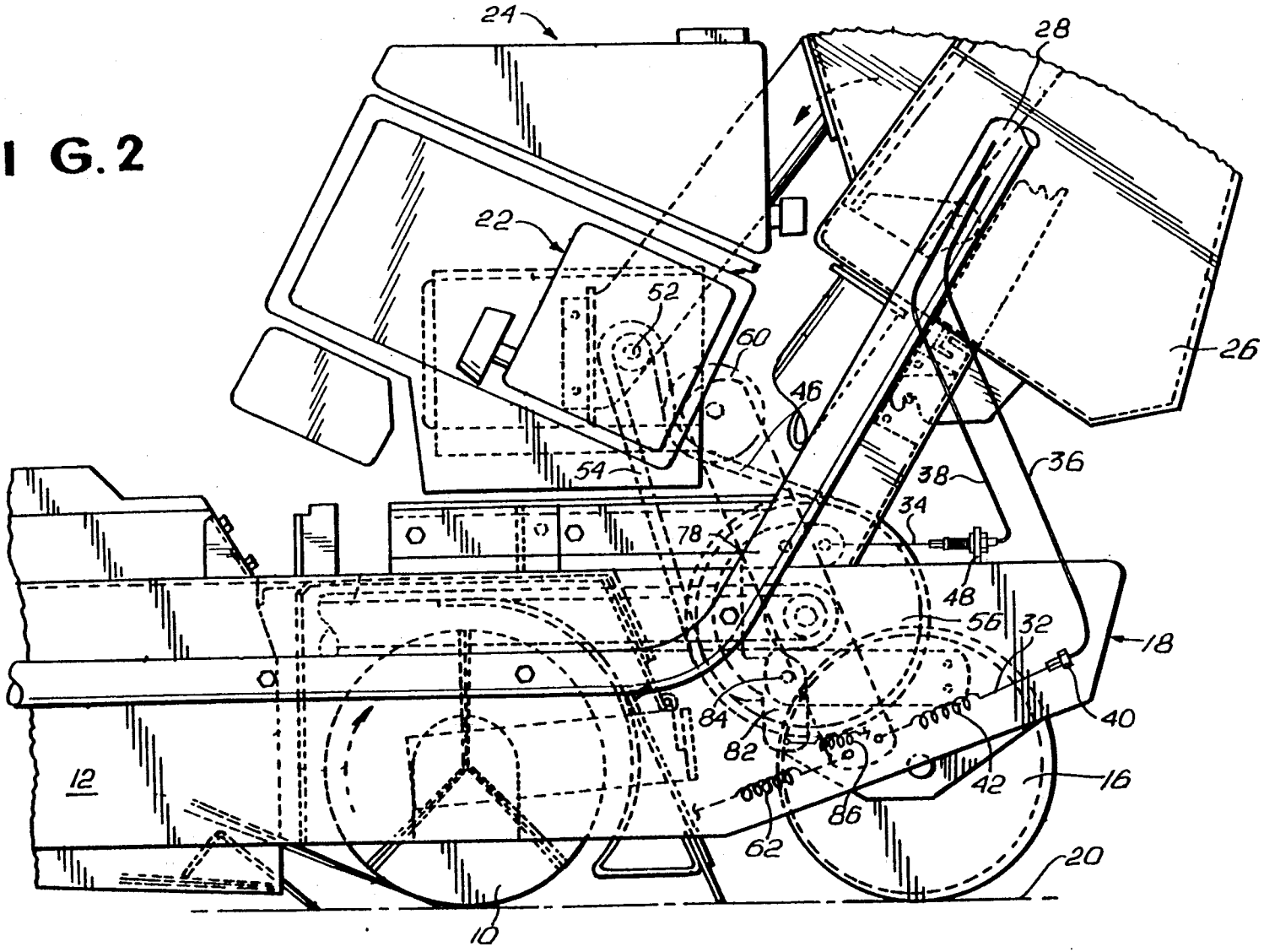
FIG. 2 is an enlarged view, in greater detail, of a portion of the sweeper shown in FIG. 1.

Referring initially to FIGS. 1 and 2, an industrial sweeper has a main brush 10 which rotates to direct debris into a hopper 12. A side brush 14 rotates to direct debris from the side of the sweeper towards its center. A drivewheel 16 near the rear 18 of the sweeper is in contact with the ground 20 and rotates to propel the sweeper. An engine 22, having a gas tank 24, serves as the power source for the sweeper and, as discussed more fully below, drives the drivewheel 16, main brush 10, and side brush 14. Although the power source depicted is a gasoline engine, the control mechanism of the present invention could also be used with an electric motor-driven sweeper or with an engine powered by other types of fuel such as liquid propane. The engine may also provide power for an air-intake system which draws dusty air out from the area around main brush 10 and deposits it into filter box 26. Generally, the engine 22 will operate continuously so as to always provide power for the air-intake system.

Filter box 26 is mounted on a handlebar 28 which may be used to steer the sweeper. On the top of the handlebar is a lever 30, which pivots. Connected to one end of lever 30 is a first cable 32 and a second cable 34. Portions of the first cable 32 and the second cable 34 are encased in the first sleeve 36 and second sleeve 38, respectively. The sleeves 36 and 38 are attached to the handle bar by a bracket.

Figure 3:
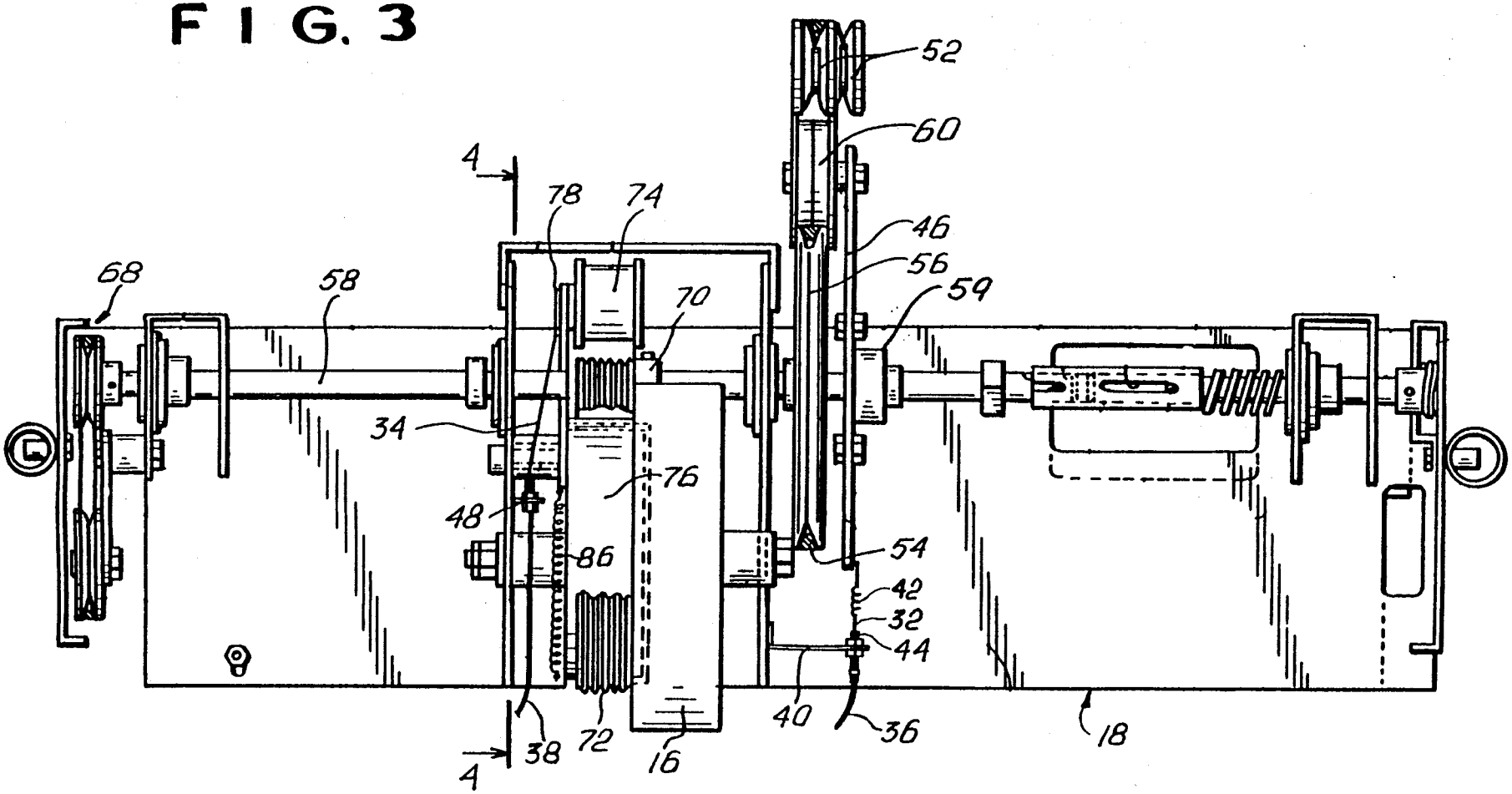
FIG. 3 is a plan view of the drive mechanism of the industrial sweeper with portions of its drive belts broken away to reveal components thereunder.

As seen in FIGS. 2–5, cable 32 and cable 34 are capable of causing engagement of the drivewheel 16 and the main brush 10 and side brush 14 with the engine 22. The first sleeve 36 is connected to a bracket 40 which holds the sleeve in place when the first cable 32 is moved. The bracket 40 can be attached to any suitable area on the frame of the sweeper. At the end of first cable 32 is a spring 42 which is in turn connected to a clutch arm 46. The first sleeve 36 may be connected to the bracket 40 by a threaded tube 44 which is held to the bracket 40 by one or more threaded nuts (FIG. 3). Similarly, the second sleeve 38 is attached to a bracket 48 which holds second sleeve 38 stationary when the second cable 34 moves therethrough.

The engine 22 rotates an engine pulley 52 which then propels the v-belt 54. The v-belt 54 in turn causes drive pulley 56 to rotate drive shaft 58. The v-belt 54 is not always tightly engaged upon both drive pulley 56 and engine pulley 52. Because of the inherent stiffness of a conventional v-belt and a substantial slack in the size of the v-belt that is provided, the v-belt will tend to return to a loosened position in which the engine pulley 52 turns freely, but the drive pulley 56 is not driven. As mentioned above, the engine 22 and therefore the engine pulley 52 runs continuously, so that it can drive the air filtration system. The drive to the drive shaft pulley 56, however, is not continuous, the pulley 56 being driven only when the v-belt 54 is tightened about engine pulley 52 and drive shaft pulley 56. This tightening is carried out by a clutch pulley 60, which bears against the v-belt 54. In this preferred embodiment, the clutch pulley is an idler with a flat surface for bearing on the outside of the v-belt 54.

Alternatively, other forms might be usable, for example, a conventional pulley with a v-shaped surface which would bear against the inside v-shaped surface of v-belt 54. The present arrangement gives greater leverage, however, and is therefore the preferred embodiment. The clutch pulley 60 in this preferred embodiment can be shifted to bear against the v-belt 54 and thereby tighten it on the engine pulley 52 and drive pulley 56 as is desired to drive the drive shaft 58. In the present preferred embodiment, the engine 22 is connected directly by a shaft to engine pulley 52. As an alternative, gears, pulleys, belts, or other transmission means may be used to convert torque from the engine 22 to the engine pulley 52.

Figure 4:
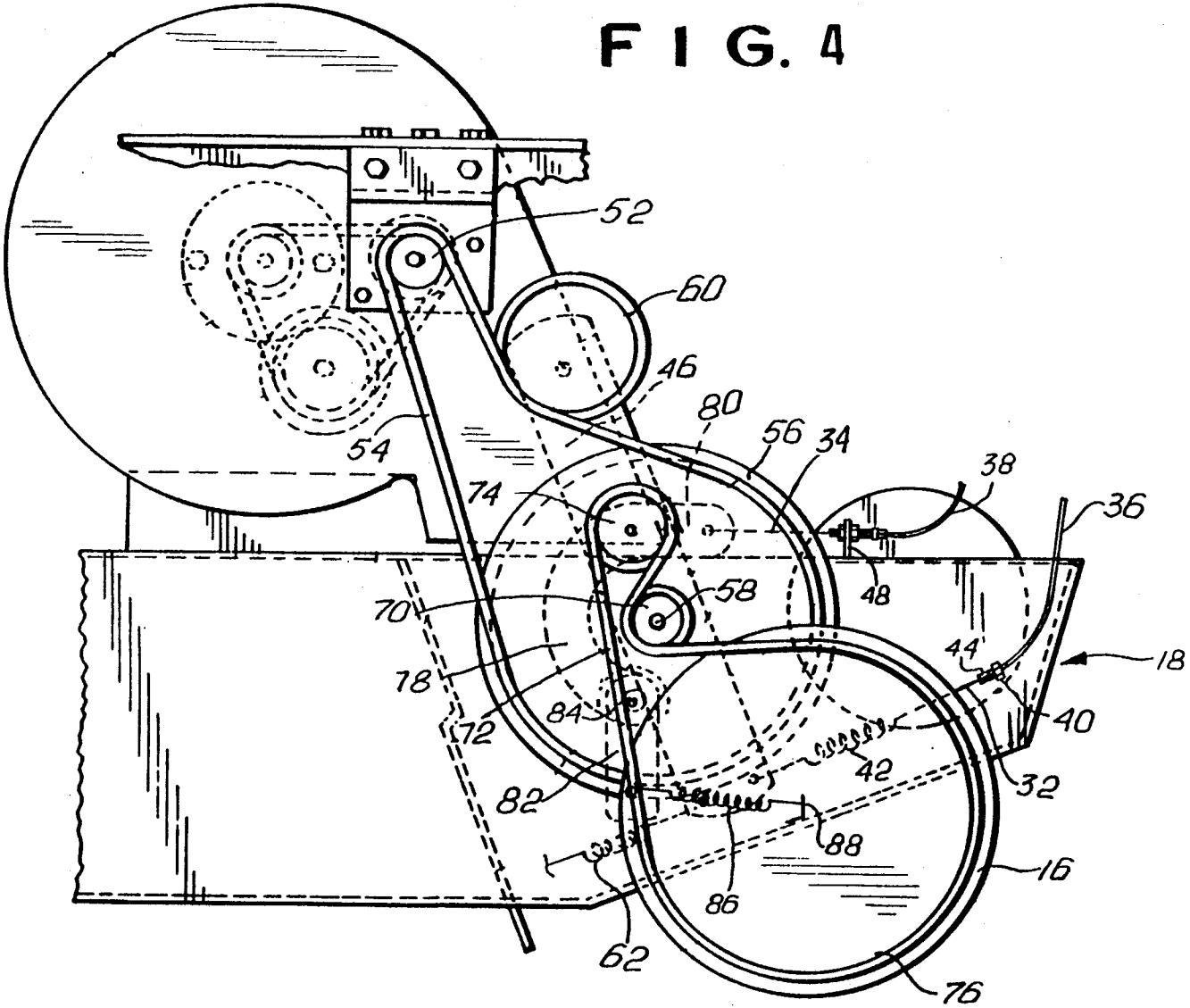
FIG. 4 is an elevational side view taken generally along the view lines 4—4 of FIG. 3, with portions omitted, showing a part of the drive mechanism of FIG. 3.
Figure 5:
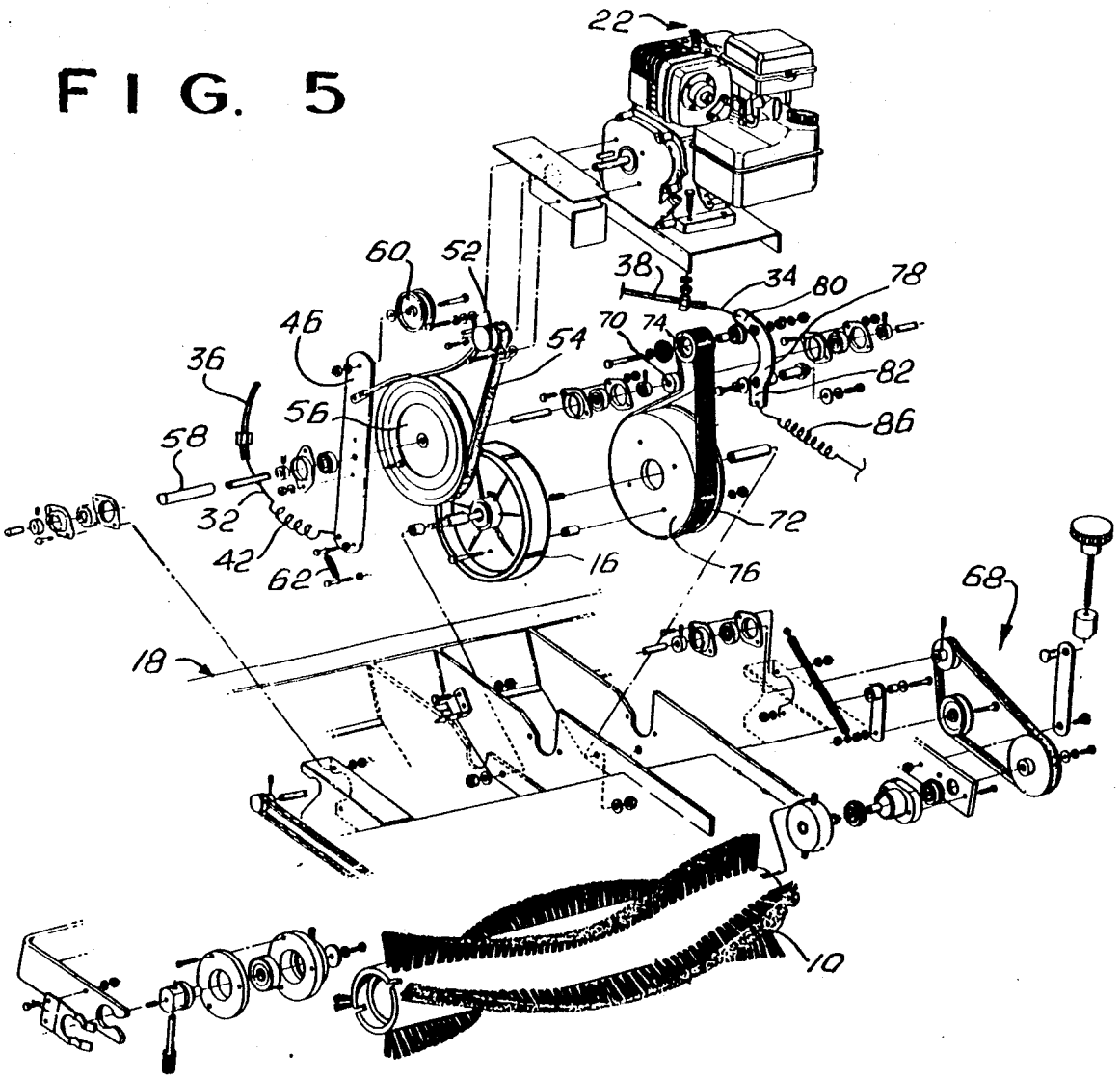
FIG. 5 is an exploded view illustrating the drive components for the main drivewheel and the main brush of the industrial sweeper.

The clutch pulley 60 is mounted by a shaft to clutch arm 46. Also, the clutch arm 46 is mounted to the drive shaft 58 by a bearing 59 for pivoting around drive shaft 58, however, a different pivot point could be provided for the clutch arm 46, if desired. The clutch arm 46 is biased by a bias spring 62 so that clutch pulley 60 is disengaged absent another force on the clutch arm. (FIGS. 2, 4, and 5). Only when first cable 32 is moved toward the rear 18 will the clutch arm 46 be rotated so that the clutch pulley 60 tensions the v-belt 54 so that the drive pulley 56 rotates.

The rotation of the drive pulley 56 and thereby drive shaft 58 impels brush-drive mechanism 68 (FIGS. 3 and 5). The brush-drive mechanism 68 has a number of belts and pulleys which are connected to the main brush 10 and the side brush 14. Brush-drive mechanism 68 is always engaged so that the main brush 10 and the side brush 14 will rotate whenever drive shaft 58 rotates. Thus control of the main brush 10 and the side brush 14 is affected by the tensioning of the v-belt 54 when the clutch pulley 60 is directed into the v-belt by the clutch arm 46. In this embodiment, the main brush 10 and the side brush 14 are simultaneously engaged and disengaged. It is also possible to have a system in which only one of these brushes is engaged by the control mechanism of the present invention.

While drive shaft 58 impels the brushes, it also serves to move the drivewheel 16, because a ground-drive pulley 70 is fixed to drive shaft 58. A poly-v-belt 72 contacts the ground-drive pulley 70 and also encircles a clutch pulley 74 and a drum drive pulley 76 which is fixed to the drivewheel 16. Because of the slack in poly-v-belt 72 ground-drive pulley 70 will not drive the drum-drive pulley 76 unless the clutch pulley 74, which serves as an idler, is directed to take up the slack.

Clutch pulley 74 is mounted on a clutch bracket 78 which has a clutch bracket upper arm 80, a clutch bracket lower arm 82, and rotates about a bearing 84. Clutch bracket lower arm 82 is connected to a bias spring 86 which is fixed by a bracket 88 to the sweeper. The bias spring 86 forces the bracket 78 in a direction such that the clutch pulley 74 permits slack to be maintained in the poly-v-belt 72 thus disengaging the drum-drive pulley 76 and the drivewheel 16 from the ground-drive pulley 70. The clutch bracket 78 may be directed to engage the clutch pulley 74 by the second cable 34 which is attached to the clutch bracket upper arm 80 (FIG. 5).

Figure 6:
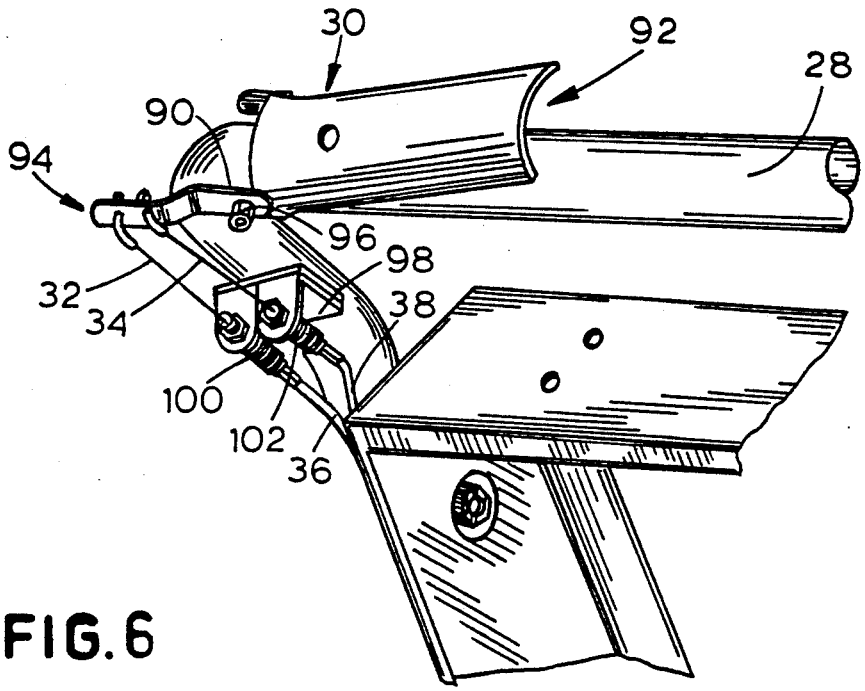
FIG. 6 is a perspective view of a portion of the control mechanism of the present invention.

Referring now to FIG. 6 the lever 30 has a middle portion indicated generally at 90, a first end indicated generally at 92, and a second end indicated generally at 94. The lever 30 may be formed of one piece of metal or other rigid material, or as shown in FIG. 6 can be made of pieces which are fixed to each other. Through the lever middle portion 90 a bolt 96 is inserted so that the lever 30 can pivot about the lever middle portion. The first end 92 is shaped and sized so that it can be gripped comfortably by a user. The second end 94 has several holes drilled therethrough so that the first cable 32 and the second cable 34 can be attached to the lever 30. The ends of the cables may have metal pieces welded thereto for ease of attachment to the lever 30. The first sheath 36 and the second sheath 38 are attached to a bracket 98 by threaded tubes 100 and 102, respectively. The threaded tubes 100 and 102 are each held to the bracket by nuts. Sheath or conduit clamps (not depicted) may also by used to attach the first sheath 36 and second sheath 38 to the handlebar 28 or other portions of the sweeper's frame so as to prevent the sheaths from becoming entangled in other parts of the sweeper.

Figure 7:
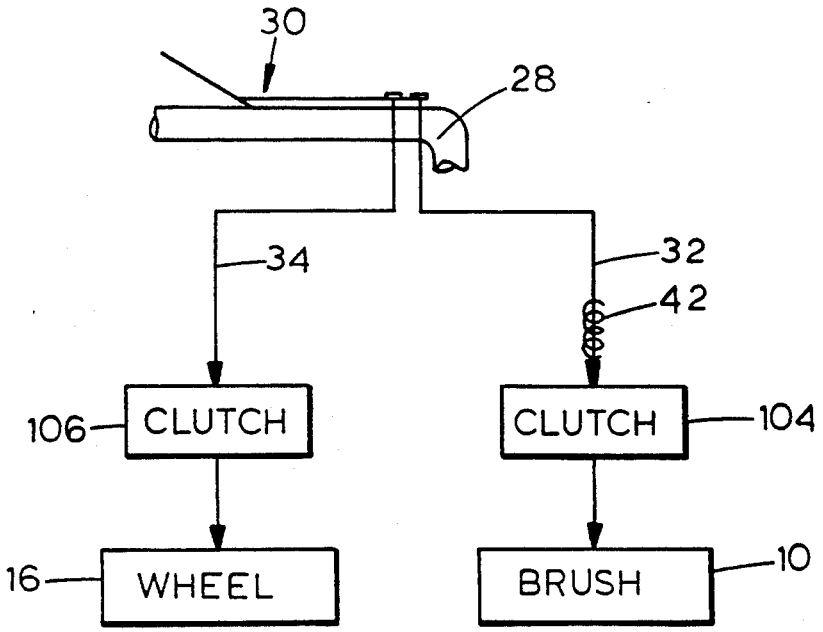
FIG. 7 is a schematic diagram illustrating the control mechanism of the present invention.

FIG. 7 diagrammatically depicts the operation of the control mechanism for the sweeper to engage and disengage the brushes and the drivewheel. When the lever 30 is grasped by a user and depressed, the lever 30 pulls first cable 32 and second cable 34 through their respective sheaths. When the handle is partially depressed, first cable 32 causes the clutch 104 to engage the brush 10. The first cable 32 is sized and adjusted in such a manner that the clutch 104 will be fully engaged when the lever 30 is depressed approximately half way to the handlebar 28. Since further depression of the lever 30 cannot further engage the clutch 104, the spring 42 attached between the clutch 104 and the first cable 32 will stretch. The spring 42 provides additional play in the control mechanism to allow the lever 30 to be fully depressed. The second cable 34 is sized and adjusted so that partial depression of the lever 30 is not sufficient to cause a clutch 106 to engage the drivewheel 16. Only upon full depression of the lever 30 will the clutch 106 engage drivewheel 16.

The lever 30 effectively has three functional positions. First, when lever 30 is not depressed, neither the first cable 32 nor the second cable 34 will have sufficient force associated therewith to cause its respective clutch to engage either the brush 10 or the drivewheel 16. If the lever 30 is partially depressed, first cable 32 is sufficiently taught to cause the clutch 104 to engage the brush 10. Second cable 34, however, will not be sufficiently taught to engage the drivewheel 16 when the lever 30 is in the second position. Finally, in the third position when the lever 30 is fully depressed, the second cable 34 will be sufficiently taut to cause the clutch 106 to engage the drivewheel 16. When the lever 30 is moved from the second position to the third position, the spring 42 stretches to allow movement of the lever.

Thus, the brushes and the drivewheel can both be controlled by only one of the user's hands. The control mechanism allows the user to engage the brushes while the sweeper is stationary in order to remove particularly large amounts of dirt or debris from a location. Moreover, the sweeper has a "deadman's switch" in that the sweeper will neither be propelled forward nor will the brushes be engaged when the sweeper is left unattended. Disengagement of the drivewheels and brushes will prevent the sweeper from moving and potentially causing harm to individuals or property.

Numerous modifications and alternative embodiments of the invention will be apparent to those skilled in the art in view of the foregoing description. Accordingly, this description is to be construed as illustrative only, and is for the purpose of teaching those skilled in the art the best mode of carrying out the invention. The details of the structure may be varied substantially without departing from the spirit of the invention, and the exclusive use of all modifications which come within the scope of the appended claims is reserved.

I claim:

1. A control device for a sweeper, said sweeper having a frame and a power source capable of driving a brush and a drivewheel, said control device comprising:

a lever mounted on said frame movable to a first position, a second position and a third position;

a first cable and a second cable each connected to said lever, said first cable attached to a first means for causing engagement and disengagement of said brush with said power source and said second cable attached to a second means for causing engagement and disengagement of said drivewheel with said power source;

wherein said brush is disengaged from said power source by said first engagement and disengagement means and said drivewheel is disengaged from said power source by said second engagement and disengagement means when said lever is in said first position, said brush is engaged to said power source by said first engagement and disengagement means and said drivewheel is disengaged from said power source by said second engagement and disengagement means when said lever is in said second position, and said brush is engaged to said power source by said first engagement and disengagement means and said drivewheel is engaged to said power source by said second engagement and disengagement means when said lever is in said third position.

2. The control device of claim 1 wherein:

said lever comprises a first end, a second end and a middle;

said lever pivots about said middle;

said first end is adapted to be gripped by a user's hand; and said second end is attached to said first cable and said second cable.

3. The device of claim 1 further comprising a spring connected to said first cable and a clutch arm connected to said spring, wherein said clutch arm causes said drivewheel to be engaged when said lever is in said second position and said spring stretches when said lever is moved from said second position to said third position.

* * * * *